US009719502B2

(12) United States Patent
Wylie et al.

(10) Patent No.: US 9,719,502 B2
(45) Date of Patent: Aug. 1, 2017

(54) DIAPHRAGM PUMPS

(71) Applicant: Munster Simms Engineering Limited, Bangor, County Down (GB)

(72) Inventors: James Wylie, Bangor (GB); David Arnaud, Bangor (GB)

(73) Assignee: MUNSTER SIMMS ENGINEERING LIMITED, Bangor, County Down (IE)

( * ) Notice: Subject to any disclaimer, the term of this patent is extended or adjusted under 35 U.S.C. 154(b) by 289 days.

(21) Appl. No.: 13/961,321

(22) Filed: Aug. 7, 2013

(65) Prior Publication Data

US 2014/0044563 A1 Feb. 13, 2014

(30) Foreign Application Priority Data

Aug. 10, 2012 (GB) ..... 1214335.0

(51) Int. Cl.
*F04B 43/02* (2006.01)
*F04B 39/12* (2006.01)
(Continued)

(52) U.S. Cl.
CPC ..... *F04B 43/026* (2013.01); *F04B 9/02* (2013.01); *F04B 9/042* (2013.01); *F04B 39/121* (2013.01); *F04B 43/04* (2013.01); *F04B 53/16* (2013.01)

(58) Field of Classification Search
CPC ..... F04B 43/026; F04B 43/14; F04B 45/043; F04B 53/1025; F04B 17/03; F04B 39/12; F04B 39/121; F04B 9/02; F04B 9/042; F04B 43/04; F04B 53/16; F04C 2230/60; F04C 2230/604; F04C 2240/40; F04D 25/06; F04D 29/40; F04D 29/60; F04D 53/16; F16K 7/12
USPC ..... 417/44.2, 44.9, 269, 316, 363, 410.1, 417/413.1, 566, 486, 498, 53, 423.14; 137/512.15, 854; 92/64, 71; 310/89
See application file for complete search history.

(56) References Cited

U.S. PATENT DOCUMENTS 2,488,945 A * 11/1949 Troller ..... F04D 19/002 417/362
3,179,058 A * 4/1965 Meagher ..... F04D 13/06 417/360

(Continued)

FOREIGN PATENT DOCUMENTS

| | | |
|---|---|---|
| GB | 2352779 | 7/2001 |
| WO | 0109510 | 2/2001 |

OTHER PUBLICATIONS

United Kingdom Search Report dated Dec. 10, 2012.

*Primary Examiner* — Theodore Stigell
*Assistant Examiner* — Chirag Jariwala
(74) *Attorney, Agent, or Firm* — Hoffman & Baron, LLP

(57) ABSTRACT

A diaphragm pump comprising a housing for receiving and securely holding a motor, the housing comprising an elongate portion having a closed end and an open end, the elongate portion being adapted to securely receive and house a motor; and a collar portion being provided at the open end of the elongate portion; a cover for the housing, the cover being adapted to engage with the housing; a diaphragm plate extending across the open end of the housing between the collar portion of the housing and the cover and being secured therebetween when the cover is engaged with the collar portion of the housing. The diaphragm pump also includes a wobble plate positioned within the collar portion of the housing.

18 Claims, 21 Drawing Sheets

(51) Int. Cl.

| | |
|---|---|
| ***F04B 43/04*** | (2006.01) |
| ***F04B 53/16*** | (2006.01) |
| ***F04B 9/02*** | (2006.01) |
| ***F04B 9/04*** | (2006.01) |

(56) References Cited

U.S. PATENT DOCUMENTS

| | | | | |
|---|---|---|---|---|
| 3,604,820 | A * | 9/1971 | Scheller | F04D 29/628 310/91 |
| 5,292,232 | A * | 3/1994 | Krohn et al. | 417/44.2 |
| 5,786,647 | A * | 7/1998 | Vollmer et al. | 310/89 |
| 5,791,882 | A * | 8/1998 | Stucker | F04B 43/026 417/269 |
| 6,293,769 | B1 * | 9/2001 | Radermacher | F04D 13/06 417/357 |
| 6,840,745 | B1 * | 1/2005 | Macauley et al. | 417/269 |
| 2007/0086888 | A1 * | 4/2007 | Patel | F04D 29/588 415/177 |
| 2007/0101860 | A1 | 5/2007 | Hsu et al. | |
| 2007/0292276 | A1 * | 12/2007 | Stutz | A61M 1/0066 417/137 |
| 2010/0014998 | A1 * | 1/2010 | Conner | 417/413.1 |
| 2012/0164010 | A1 * | 6/2012 | Pascual | F01C 21/007 417/410.5 |

* cited by examiner

FIGURE 21A
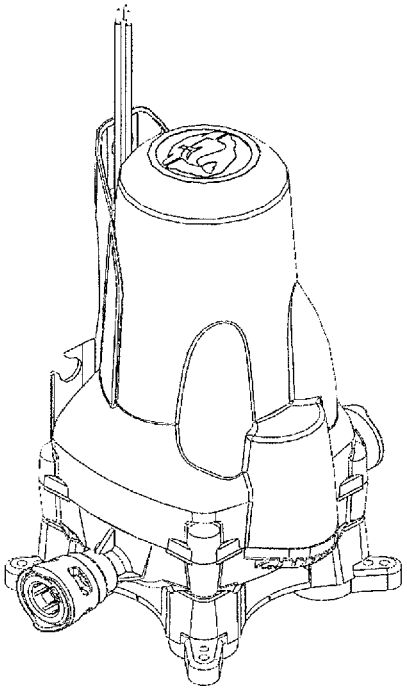
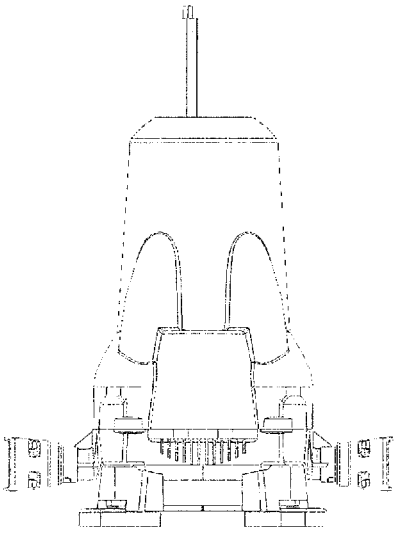
FIGURE 21B
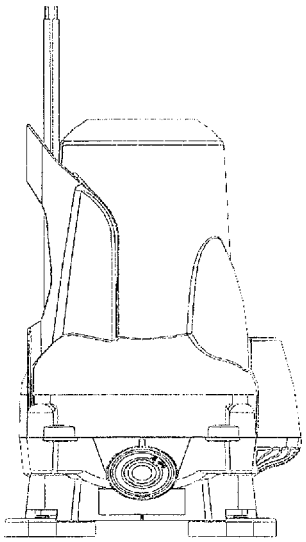
FIGURE 21C

DIAPHRAGM PUMPS

CROSS-REFERENCE TO RELATED APPLICATIONS

This application claims priority from United Kingdom Patent Application No. GB 1214335.0 filed on Aug. 10, 2012.

BACKGROUND OF THE INVENTION

Field of the Invention

The present invention concerns improvements in and relating to diaphragm pumps.

Description of the Related Art

United Kingdom Patent Specification No. GB 2 352 779 B and European Patent Specification No. EP 1 222 392 B disclose a diaphragm pump comprising a two-part casing formed of a front cover and a back cover; and a diaphragm plate extending across the covers and being secured therebetween when the covers are fastened together. The diaphragm plate has a plurality of circular regions. The front cover has substantially axially aligned inlet and outlet ports, each leading to mutually exclusively inlet and outlet chambers. There is a valve housing securable inside the front cover and having defined therein an outlet dished valve seat with a correspondingly concave resilient outlet valve seated therein, the outlet dished valve seat having fluid passages therethrough, and a plurality of inlet valve seats, equal in number to the number of circular regions on the diaphragm plate, each inlet valve seat being similarly dished and having a correspondingly concave resilient valve seated therein, each inlet valve seat having fluid passages therethrough, the resilient outlet valve being in fluid communication with the outlet chamber and each said inlet valve being in fluid communication with the inlet chamber. The diaphragm pump also includes a wobble plate positioned in the back cover; the wobble plate has a central boss and a plurality of similar piston sections equal in number to the number of circular regions on the diaphragm plate, the piston sections and circular regions being correspondingly secured together, the wobble plate being subject to nutating motion to cause reciprocating action by the circular regions on the diaphragm plate and provide a pumping action.

The present invention relates to improvements to the diaphragm pump disclosed in GB 2 352 779 B and EP 1 222 392 B and provides technical advantages over the previously known diaphragm pumps.

SUMMARY OF THE INVENTION

The present invention accordingly provides a diaphragm pump comprising a housing for receiving and securely holding a motor, the housing comprising an elongate portion having a closed end and an open end, the elongate portion being adapted to securely receive and house a motor; and a collar portion being provided at the open end of the elongate portion; a cover for the housing, the cover being adapted to engage with the housing; a diaphragm plate extending across the open end of the housing between the collar portion of the housing and the cover and being secured therebetween when the cover is engaged with the collar portion of the housing; the diaphragm pump comprising a motor locking plate adapted to be secured to the motor such that when the motor locking plate is secured to the motor and with the motor inserted in the elongate portion of the housing, at least a portion of the motor locking plate is provided within the collar portion of the housing; the diaphragm plate having a plurality of similarly defined circular regions the cover having substantially axially aligned inlet and outlet ports each leading to mutually exclusive inlet and outlet chambers respectively, a valve housing securable inside the cover and having defined therein at least one outlet valve seat, the outlet valve seat being in fluid communication with the outlet chamber and the pump have at least one inlet valve seat the inlet valve seat being in fluid communication with the inlet chamber; and a wobble plate positioned within the collar portion of the housing, the wobble plate having a central boss and a plurality of similar piston sections equal in number to the number of circular regions on the diaphragm plate, the piston sections and circular regions on the diaphragm plate being correspondingly secured together, whereby in use, when the motor is activated, the wobble plate is subject to nutating motion to cause reciprocating action of the circular regions and thereby provide a pumping action.

Heretofore, known diaphragm pumps required a two-part casing including a front cover and a rear cover between which covers, a diaphragm plate extended and the diaphragm cover was secured between the covers.

The diaphragm pump of the present invention has an advantage that only one cover is required and the motor is securely housed within an integrally formed motor housing having a collar portion at an open end of the housing, the collar portion being adapted for sealingly engaging with the cover. This has the advantage that only the cover is required to seal the open end of the motor housing.

Advantageously, the elongate main body of the housing is provided with a plurality of elongate ribs provided at spaced apart locations on the inside walls of the elongate main body and extending along substantially the length of the elongate main body.

Ideally, the motor locking plate comprises an engagement lug for engaging with the wobble plate and optionally, wherein a plurality of radially extending ribs extend from around the engagement lug.

Preferably, the engagement lug is adapted for engagement with the wobble plate such that the drive shaft of the motor is engaged with a bearing on the wobble plate to drive the nutating action of the wobble plate so as to cause movement of the circular portions of the diaphragm plate.

The motor locking plate ideally also comprises an enclosure for receiving and housing a switch whereby an integral pressure switch can be provided on the motor locking plate.

The motor locking plate advantageously also comprises a barrel for receiving a spiral spring and plunger.

The plunger ideally includes an arm operable for pressing on the micro-switch when the plunger is pressed inwardly so as to activate the micro-switch and thereby activating the motor.

Furthermore, the plunger may be of different lengths so as to pre-set the maximum pressure of the pump to a predetermined setting.

The motor housing is beneficially adapted to receive and house a motor of a relatively short dimension or a relatively longer dimension.

Ideally, the diaphragm support plate for supporting the diaphragm plate is provided in the collar portion of the housing, the diaphragm support plate having an equal number of similar apertures corresponding to the number of circular regions on the diaphragm plate each aperture having a walled surround, the circular regions of the diaphragm plate fitting into respective apertures in the diaphragm support plate and being supported thereby.

Preferably, the circular regions of the diaphragm plate are each provided with an outstanding lug formation and the mating surfaces of the piston sections of the wobble plate are provided with complimentary shaped slots, the securement being formed when the lug formation of each circular region is engaged in the slot of the corresponding piston section. The lug formation of each diaphragm and the slot of each corresponding piston section is beneficially of cruciform shape. The outer ends of the lug formation are preferably of greater length than the slots to provide a locking means in the slots. A diaphragm support plate may be provided, the support plate having an equal number of similar apertures corresponding to the number of circular regions on the diaphragm plate, each aperture on the diaphragm support plate having a walled surround, the circular regions on the diaphragm plate fitting into respective apertures of the diaphragm support plate and being supported thereby.

The housing preferably has a series of mounting feet fitted thereto, some of the feet being substantially ovoid in plan; and optionally at least one of the feet being substantially circular in cross-section. The feet are formed of resilient material.

The diaphragm plate is provided with a further defined circular region which is smaller than the other plurality of defined circular regions; and the diaphragm support plate has a similarly shaped aperture with wall surround to accommodate a micro-switch activated by movement of the further circular region serving as a pressure switch pad, the electrical wires to the micro-switch being fed internally from the front face of the motor.

The valve housing is preferably provided, on the same side as the inlet valve seats are positioned, with a track leading from a hole exiting on that side and centrally provided in the outlet valve seat provided on the opposite side, the track mating with a corresponding track provided on the diaphragm plate, the mated tracks forming a passage between the hole and the further circular region whereby any fluid leaving the outlet chamber, when under pressure through the screw, travels along the passage and fills a void at the pressure pad on the opposite side of the diaphragm plate from the pressure switch causing activation of the micro-switch to stop the pump.

Preferably further, the valve housing is fixed to the cover by a fixing means such as a screw.

Advantageously, the at least one valve seat has a corresponding concave resilient valve seated therein and preferably, the pump has a plurality of inlet valve seats, equal in number to the number of circular regions on the diaphragm plate, each inlet valve seat having a corresponding concave resilient valve seated therein, each inlet valve seat having fluid passages therethrough.

The improved diaphragm pump of the present invention will now be described more particularly, by way of example only, with reference to the accompanying drawings in which are shown a number of embodiments of the improved diaphragm pump of the present invention.

BRIEF DESCRIPTION OF THE DRAWINGS

In the drawings:

in FIG. 1, the motor locking plate is shown connected to the motor by four screws and connectable to the motor housing by three screws;

FIGS. 9A to 12C showing the valve housing, the diaphragm plate, the diaphragm support plate and the wobble plate include similar features as previously described in EP 1 222 392 and are included here for descriptive purposes in describing the functioning of the pump.

FIG. 17A is a perspective view from underneath of the motor and motor housing locking plate located within the housing and also shows the feet of the diaphragm pump of the present invention;

FIG. 17B is an exploded view of FIG. 12A showing the detail of the ribs provided at spaced apart intervals and provided longitudinally along the length of the main body of the housing for abutting against the motor when the motor is inserted in the housing;

FIG. 17C is a plan view from the rear of the diaphragm pump showing the closed end of the motor housing and the feet of the diaphragm pump;

FIG. 20A is a longitudinal side view of horizontally mounted pump;

FIG. 20B is a plan view of horizontally mounted pump;

FIG. 20C is a perspective view of horizontally mounted pump;

FIGS. 21A, 21B and 21C respectively show the assembled diaphragm pump in accordance with the present invention mounted in a vertical position;

FIG. 21A is a perspective view of a vertically mounted assembled pump;

FIG. 21B is a side view from a first side of the vertically mounted assembled pump; and FIG. 21C is a side view from a second side of the vertically mounted assembled pump.

DETAILED DESCRIPTION OF THE INVENTION

Figure 1:
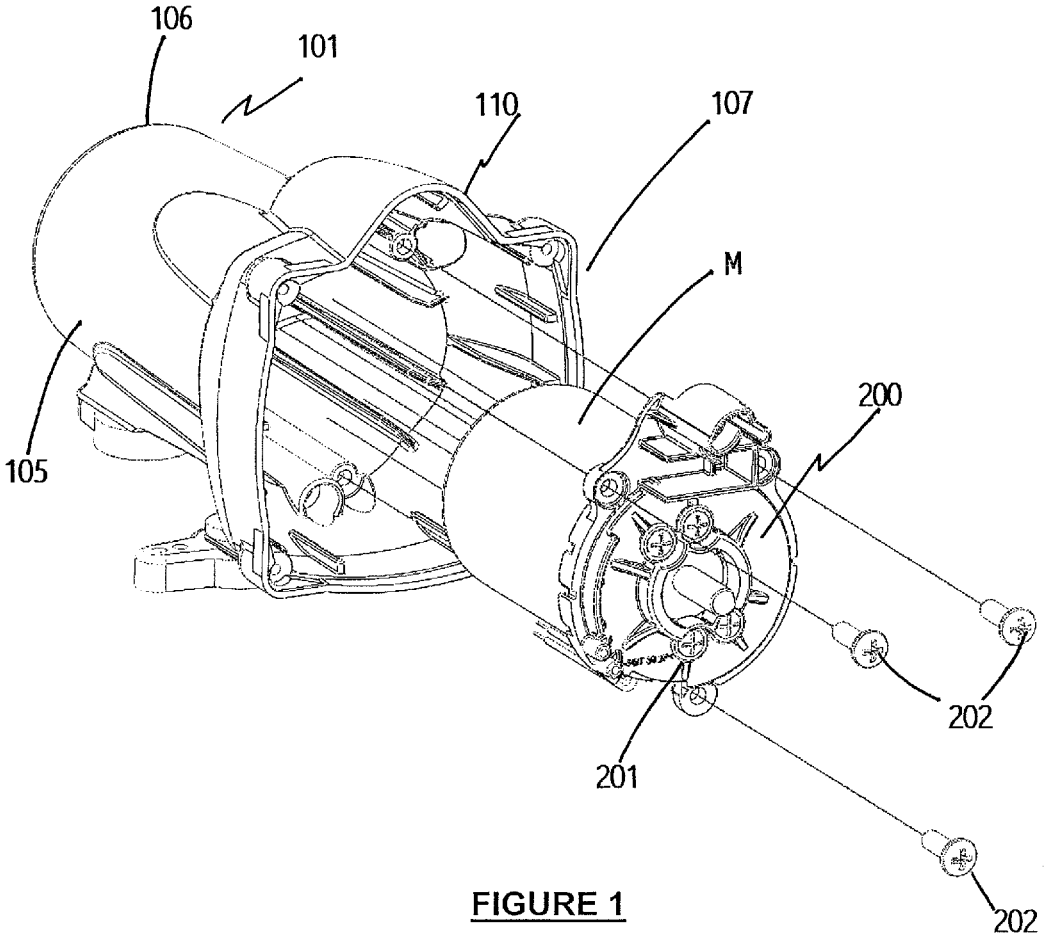
FIG. 1 is a perspective view of the motor housing adapted for receiving and securely housing the motor; and the motor lock assembly comprising the motor and the motor locking plate.
Figure 2:
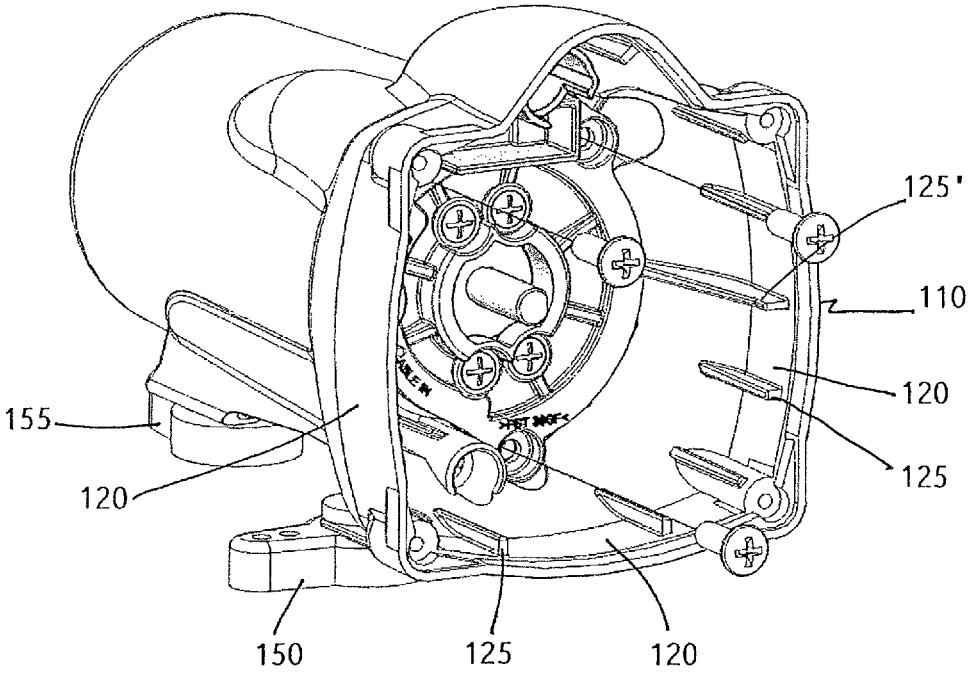
FIG. 2 is a perspective view of the motor locking assembly comprising the motor and the motor locking plate inserted in the motor housing such that the motor is securely received and locked in the main body of the housing i.e. the elongate portion of the housing; and with the motor locking plate being located within the collar portion of the housing; the motor locking plate being securable to the housing by fixing means, preferably, three screws.
Figure 3:
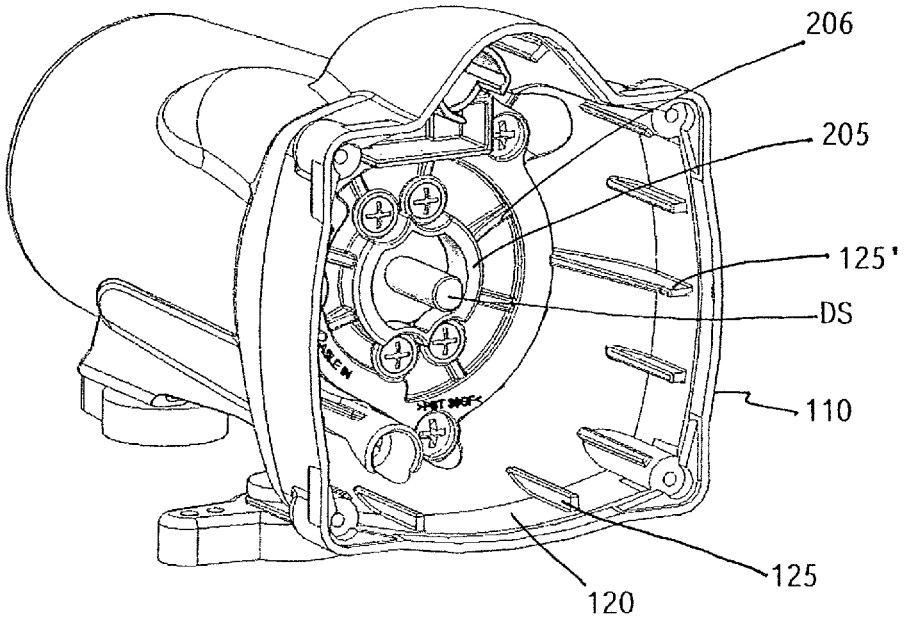
FIG. 3 is a perspective view of the motor housing with the motor and the motor locking plate secured and locked in the motor housing.
Figure 4:
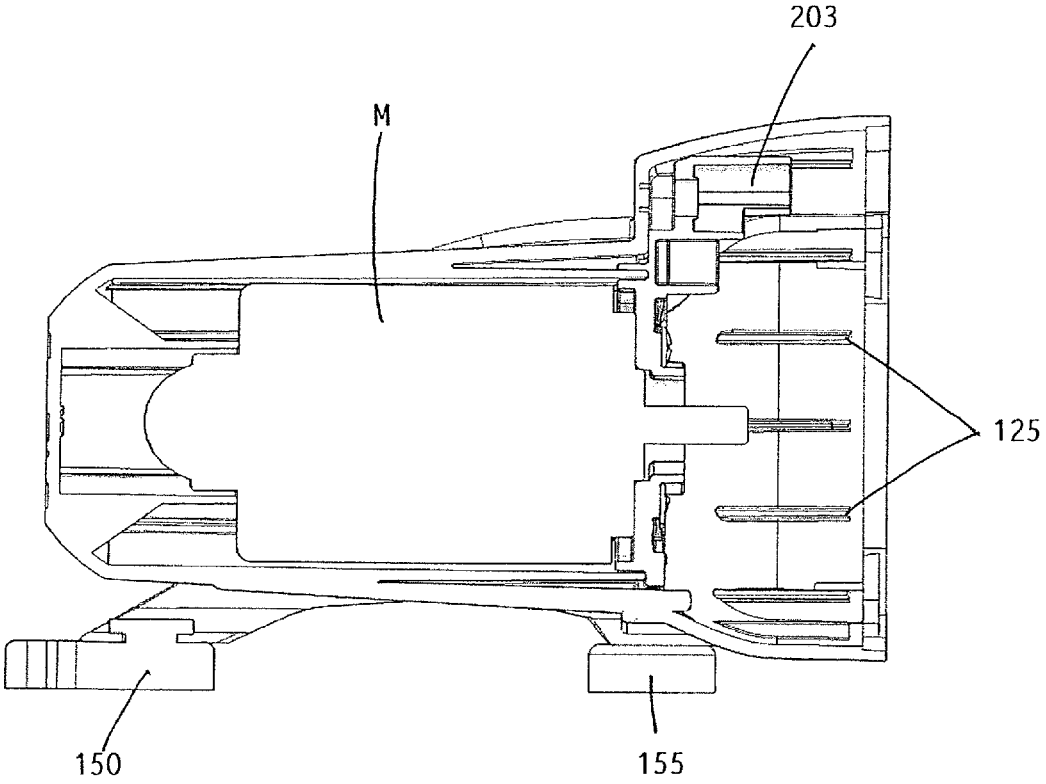
FIG. 4 is a side sectional view of FIG. 3 with the motor and motor locking plate within the motor housing.
Figure 5:
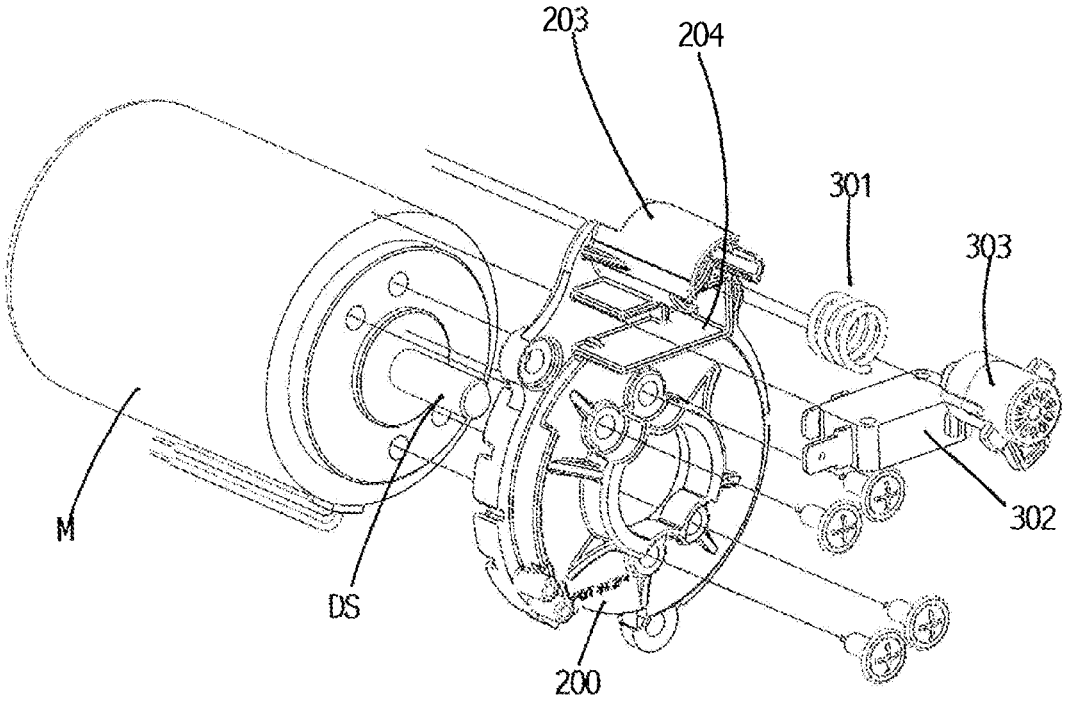
FIG. 5 is an exploded view (without the motor housing) of the motor the motor locking plate, a switch, a spiral spring and plunger; and four screws for securing the motor locking plate to the motor.
Figure 6:
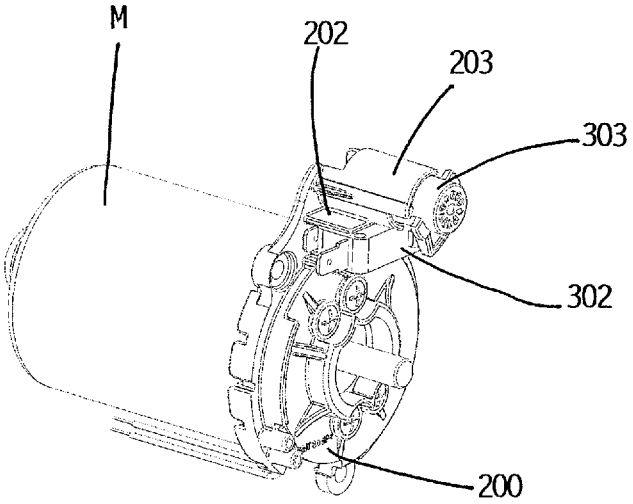
FIG. 6 is a perspective view of the motor and motor locking plate connected together by the four screws; and showing the micro-switch located within an enclosure provided in the motor locking plate, for the micro-switch and showing the spiral spring and plunger received within the plunger barrel located adjacent to the micro-switch housing on the motor locking plate.
Figure 7A:
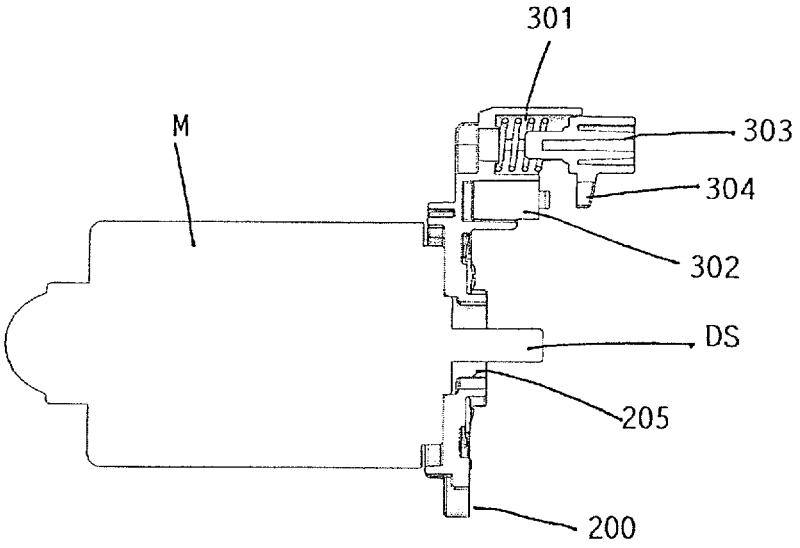
FIG. 7A is a side sectional view of the assembled motor and motor locking plate shown in FIG. 6 with the plunger shown out of engagement with the micro-switch.
Figure 7B:
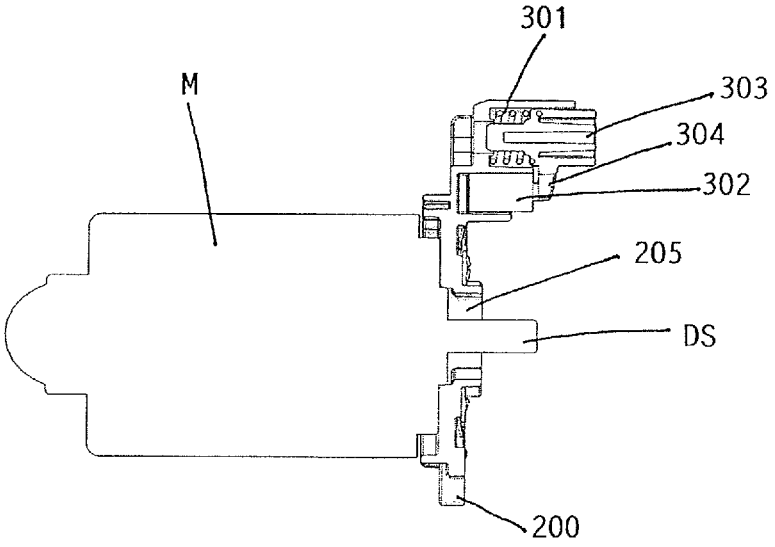
FIG. 7B is a side sectional view of the assembled motor and motor locking plate shown in FIG. 6 as for FIG. 7A but now with the plunger shown in contact with the micro switch to activate the micro-switch so as to turn on the motor.

Referring to the drawings, a diaphragm pump in accordance with the present invention is indicated generally by reference number 100 and comprises a housing 101 and a cover 10 adapted to securably engage with the housing 101. The diaphragm pump 100 comprises the motor housing 101 for receiving a motor M and a motor locking plate 200 engageably attached to the motor M by fastening means comprising four screws 201. The motor locking plate 200 can be secured to the housing 101 by fastening means comprising three screws 202.

Figure 8A:
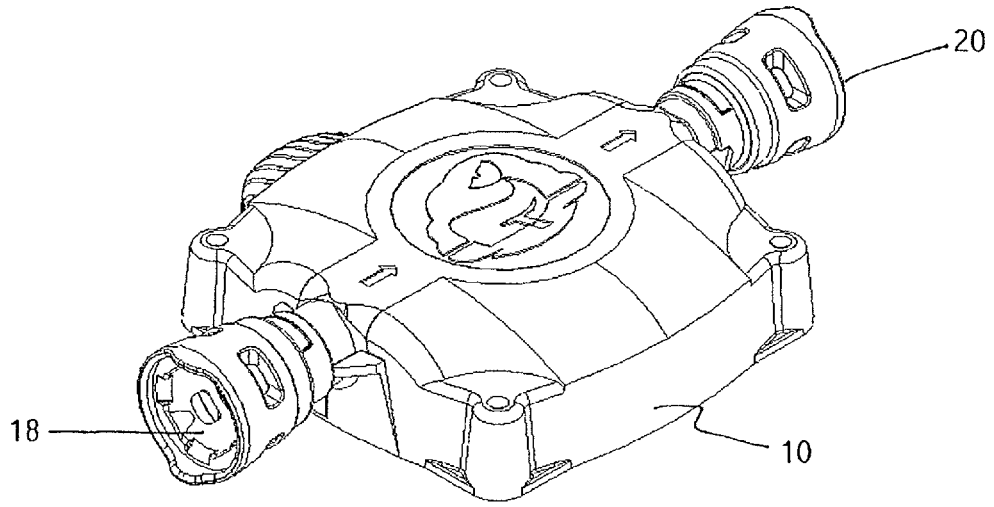
FIGS. 8A and 8B are perspective views from above and from below the cover for the motor housing which is engaged with the motor housing to encase the component parts and to form the assembled diaphragm pump of the present invention.
Figure 8B:
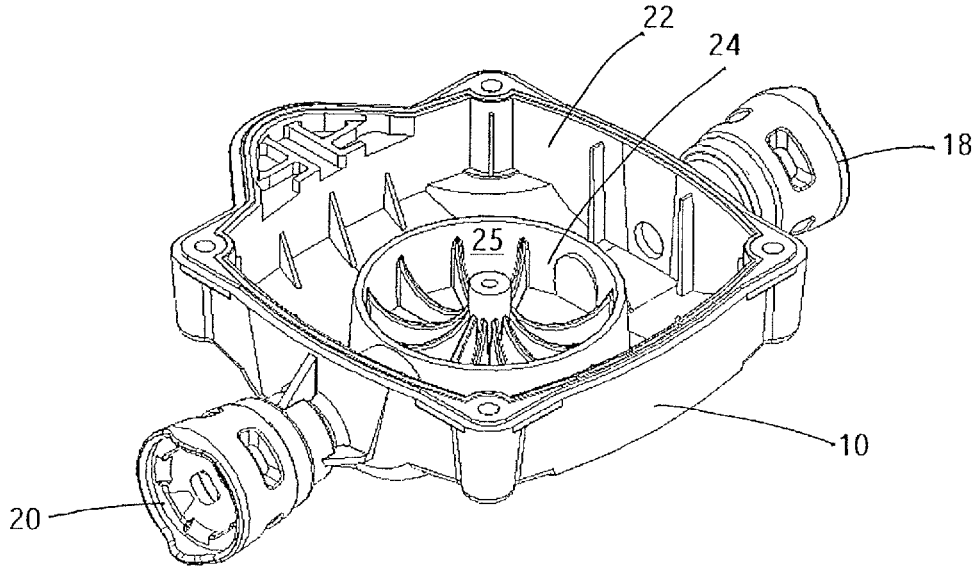
Figure 9A:
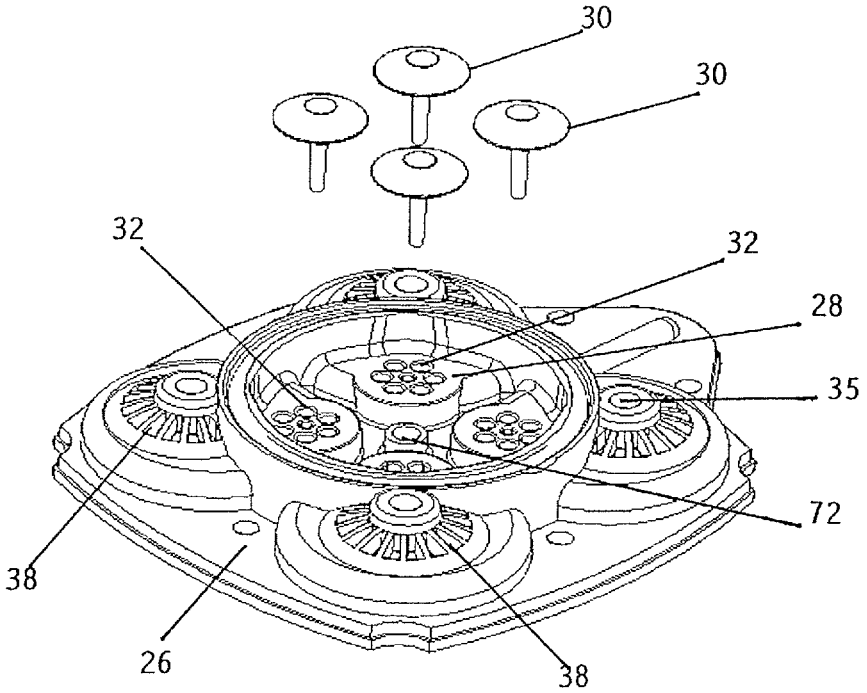
FIGS. 9A and 9B are respectively perspective views from above and from below of a valve housing of the diaphragm pump.
Figure 9B:
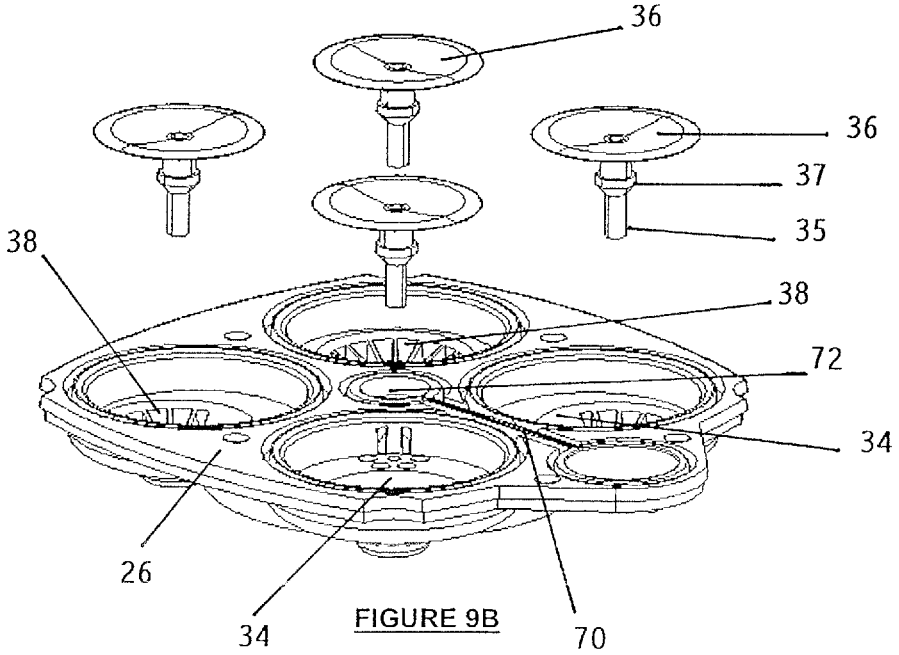
Figure 10A:
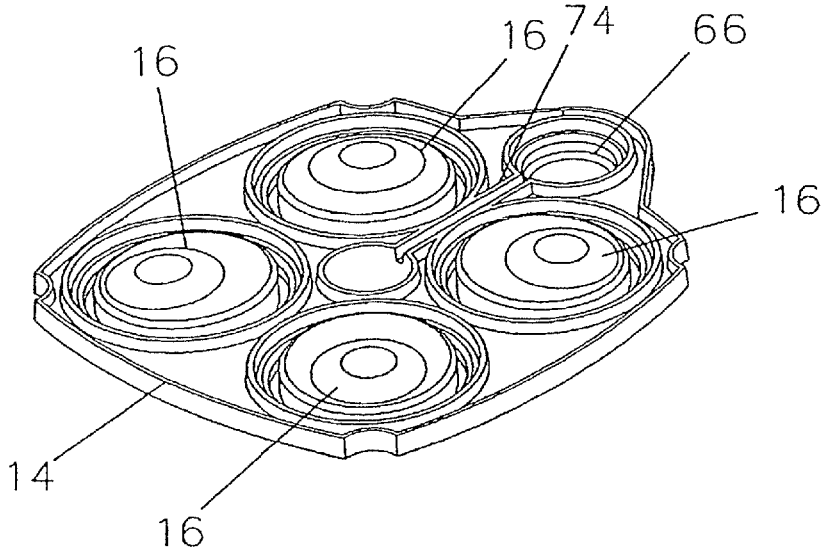
FIGS. 10A and 10B are, respectively, perspective views from above and from below of a diaphragm plate of the pump.
Figure 10B:
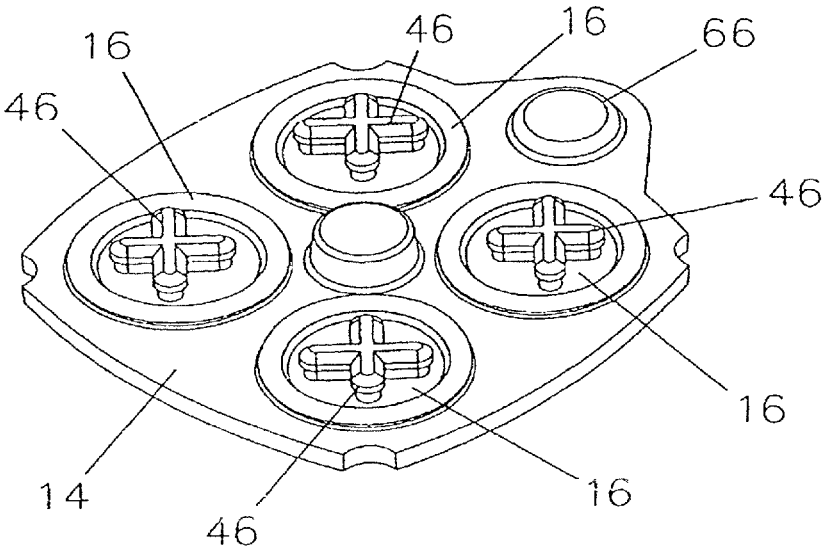
Figure 11A:
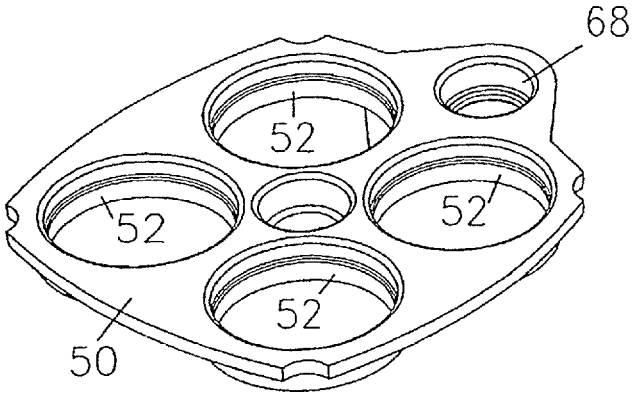
FIGS. 11A and 11B are, respectively, perspective views from above and from below of a diaphragm support plate of the pump.
Figure 11B:
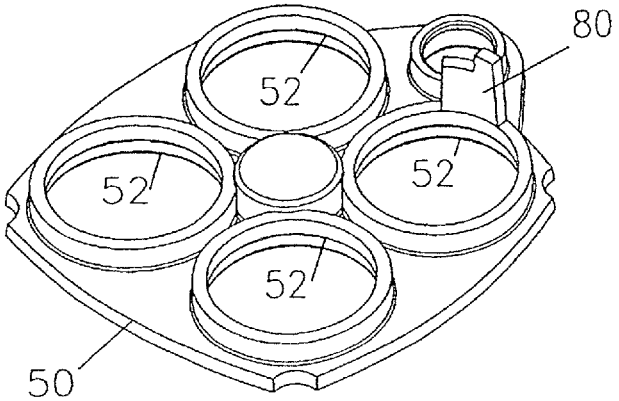
Figure 12A:
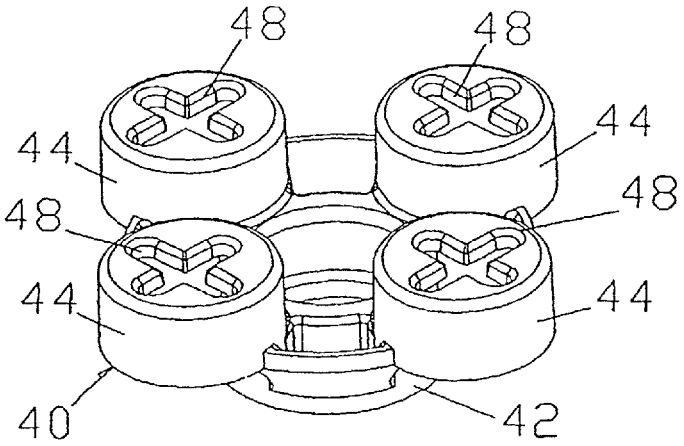
FIGS. 12A, 12B and 12C are, respectively, a perspective view from above, a perspective view from below, and a cross-sectional view of a wobble plate of the pump.
Figure 12B:
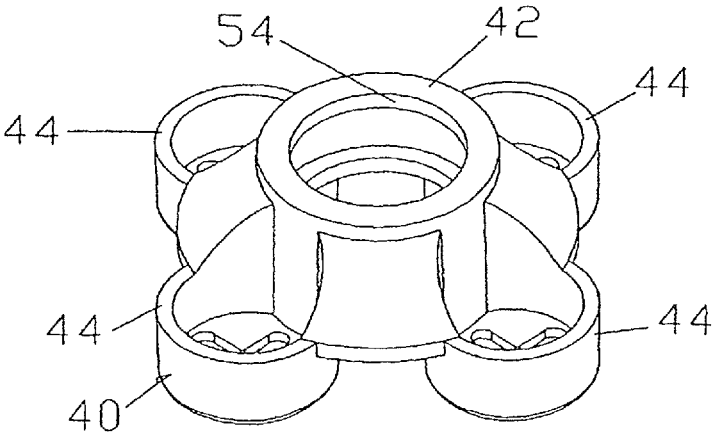
Figure 12C:
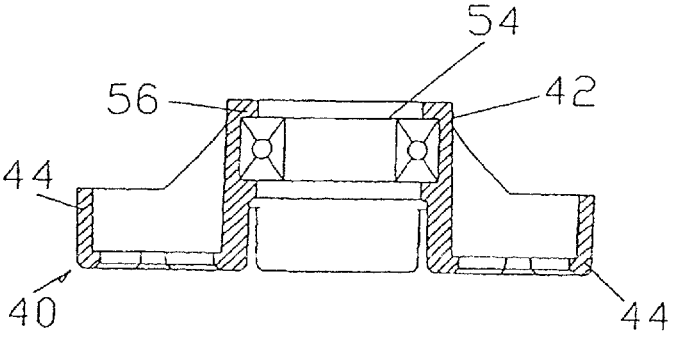
Figure 13:
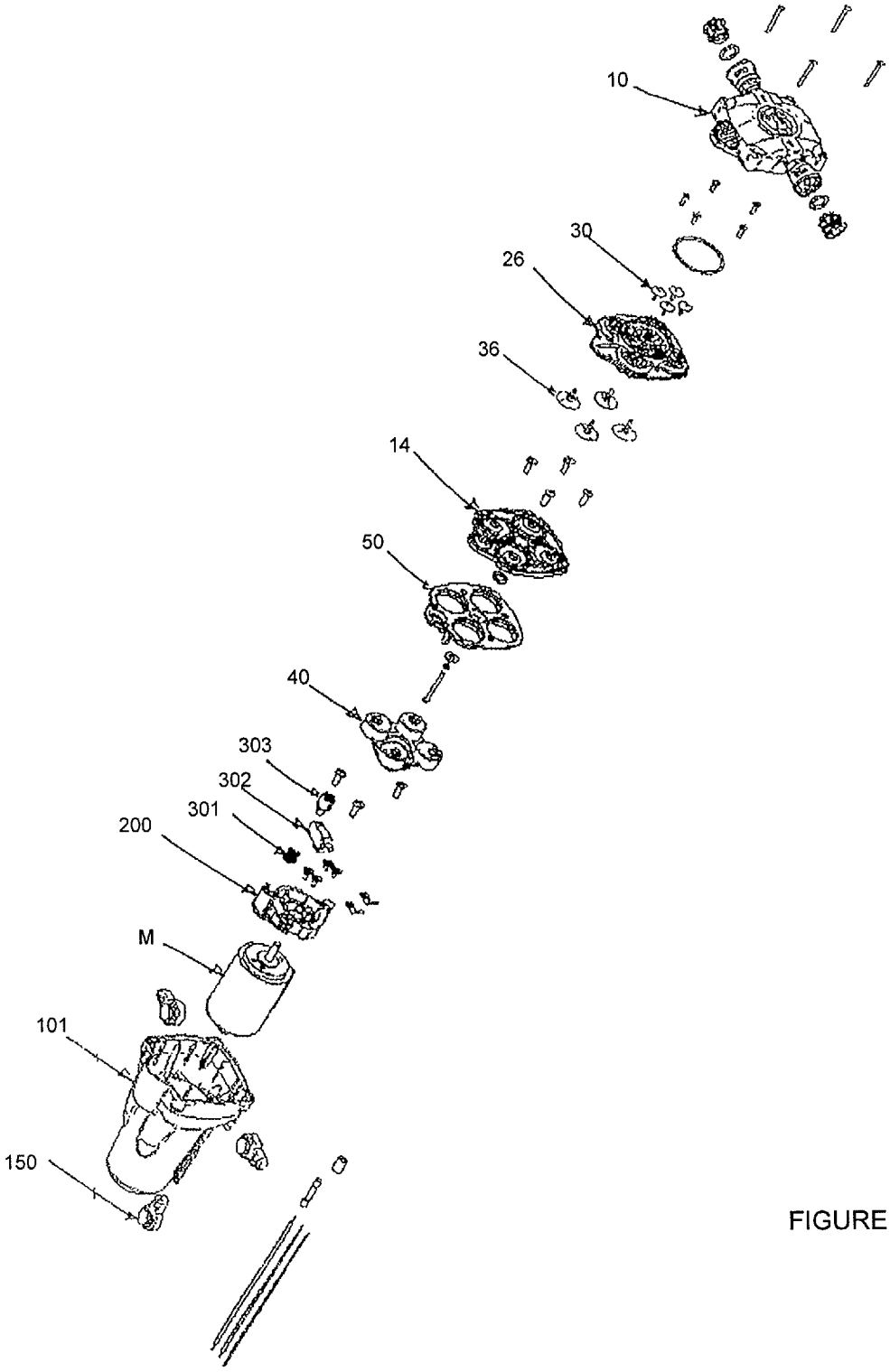
FIG. 13 is an exploded view of the components to be assembled to form the diaphragm pump of the present invention.
Figure 14:
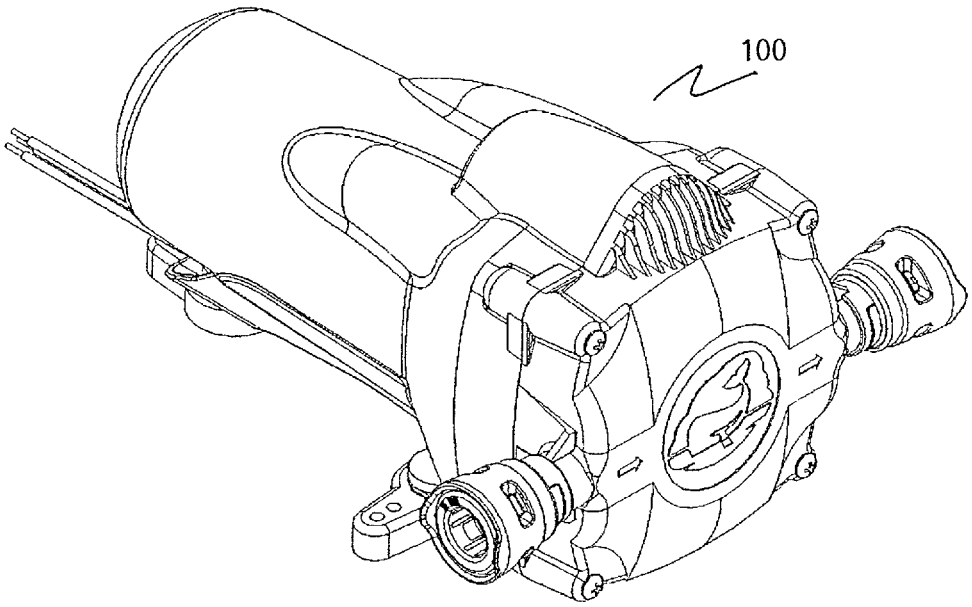
FIG. 14 is a perspective view of an assembled pump.

The motor housing 101 comprises an elongate main body 105 having a closed end 106 and an open end 107. At the open end 107, the housing 101 is provided with a collar portion 110 which is adapted to engage with a cover 10 shown in FIGS. 8A and 8B. The collar portion 110 has upstanding walls 120 having ribs 125, 125' for providing a seal when the cover 10 is engaged with the collar portion 110. The ribs 125, 125' also provide structural support to the collar portion 110

The elongate main body 105 of the housing 101 is provided with a plurality of elongate ribs 115 provided at spaced apart locations on the inside walls of the elongate main body 105 and extending along substantially the length of the elongate main body 105. The ribs 115 are adapted to absorb the torque from the motor M, when the motor is located in the elongate main body 105 and when the motor has been activated and is operating in use.

The ribs 115 tend to grip the motor M as the motor vibrates when in use. Torque is transmitted by the motor and tends to force the motor to turn. The tendency of the motor to turn forces the motor to engage against the ribs 115 and thereby lock the motor more securely in the housing 101.

Furthermore, the ribs 115 have the effect of ensuring that the motor is not abutting against the inside walls of housing 101 so that the walls of the motor are spaced apart from the major face of the inside walls of the elongate main body 105. Because of this spacing apart function of the ribs 115, there is a layer of air between the motor and the major face of the inside walls of the elongate main body 105 of the housing 101. This assists cooling of the motor because of more effective heat dissipation from the motor when in use.

The diaphragm pump 100 also includes a motor locking plate 200 which is adapted to be secured to the motor M. The motor locking plate 200 comprises a lug 205 from which radiate a plurality of radially extending ribs 206 for providing structural strength to the motor locking plate 200.

The lug 205 is for structural support. In use, the drive shaft DS of the motor is engaged with a bearing 54 on the wobble plate 40 to drive the nutating action of the wobble plate 40 so as to cause movement of the circular portions 16 of the diaphragm plate 14.

The motor locking plate 200 also comprises an enclosure [202] 204 for receiving and housing a micro-switch 302.

Furthermore, the motor locking plate 200 also comprises a barrel for receiving a spiral spring 301 and plunger 303. The plunger 303 includes an arm 304 for pressing on the micro-switch when the plunger is pressed inwardly so as to activate the micro-switch 302 and thereby activating the motor M.

The motor locking plate 200 has two setting such that the motor locking plate has a control function. The pressure switch location and operation is supported by the locking plate design.

A diaphragm plate 14 extends across the open mouth of the collar portion 110 and is located between the collar portion 110 and the cover 10 and is sealingly secured therebetween when the cover 10 is engaged with the housing by fixing means such as the three screws. The diaphragm plate 14 has a plurality of four similarly defined circular regions 16.

The cover 10 has substantially axially aligned inlet and outlet ports 18, 20, each leading to mutually exclusive inlet and outlet chambers 22, 24, respectively. The outlet chamber 24 is provided centrally of the cover 10 and has a wall surround 25 through which the outlet port 20 communicates. The inlet chamber 22 is defined between the wall surround 25 and a wall of the cover 10.

A valve housing 26 is substantially planar and is secured inside the front cover 10 and has defined therein on one side, four outlet valve seats 28 with a correspondingly resilient valve 30 seated in each valve seat 28. The outlet valve seats 28 have a plurality of holes 32 forming fluid passages therethrough; and the outlet valve seats 28 are arranged about a central hole 72. On the opposite side of the housing 26, a plurality of four inlet valve seats 34 are provided, each having a correspondingly concave resilient valve 36 seated therein, each inlet valve seat 34 having arcuate gridded areas 38 forming fluid passages therethrough and a central hole 73. The four outlet valve seats 28 are in fluid communication with the outlet chamber 24; and the inlet valve seats 34 are in fluid communication with the inlet chamber 22. Each valve 36 is formed of a dished, part-spherical portion having a post 35 radially outstanding from its rear face, the post having a bulbous portion 37, the valve being seated by the post 35 being pushed through the hole 72, 73 respectively with the bulbous portion 37 holding the valve in position preventing unintentional removal.

A wobble plate 40 is positioned within the collar portion 110 of the housing 101. The wobble plate has a central boss 42 and a plurality of four similar piston sections 44. The piston sections 44 and circular regions 16 are correspondingly secured together. The wobble plate 40 is subject to nutating motion, like 'four cylinders', to cause reciprocating action by the circular regions 16 of the diaphragm plate 14 sequentially and provide a pumping action.

The circular regions 16 of the diaphragm plate 14 are each provided with an outstanding lug formation 46 and the mating surfaces of the piston sections 44 of the wobble plate 40 are provided with complementary shaped slots 48. The securement between them is formed when the lug formation 46 of each circular region 16 is engaged in the slot 48 of the corresponding piston section 44. The lug formation 46 of each circular region 16 diaphragm plate 14 and the slot 48 of each corresponding piston section 44 is of cruciform shape. The outer ends of the lug formation 46 are of greater length that the slots 48 to provide a locking means with the slots 48.

A diaphragm support plate 50 is adapted to engage with the collar portion 110 of the motor housing such that the diaphragm support plate 50 engages with the upstanding walls of the collar portion 110; and the diaphragm plate 14 is engaged on the diaphragm support plate 50 so that the assembled diaphragm support plate 50 together with the diaphragm plate 14 form a seal between the collar portion 110 and the cover 10 when assembled and fixed together by fixing means such as screws. The diaphragm support plate 50 has four apertures 52 which are similar to each other. Each aperture 52 has a walled surround with the circular regions 16 fitting into respective apertures 52.

The boss 42 of the wobble plate 40 seats and holds by an inwardly-extending retaining flange 56 a bearing 54 having a ball race, the bearing 54 preferably having been insert moulded in the boss 42.

The electric motor 76 drive shaft DS is connected to the bearing 54 via the lug 205 provided on the motor locking plate 200. The lug 205 has radially extending ribs 206 for strengthening the motor locking plate 200. The engagement lug 205 fits into the wobble plate 40 with the drive shaft of the motor engaging the bearing 54.

The housing 101 has a plurality of mounting feet 150, 155 fitted thereto, the feet 150 are each being substantially ovoid in plan and feet 155 is circular. The feet 150, 155 are of resilient material to dampen vibratory movement. The two feet 150 are similarly provided with two fixing holes at their narrower end and being capable of rotating in and about their respective mating slot. A single foot 155 which is generally circular in cross-section is provided towards the closed end of the housing.

The valve housing 26 is fixed to the cover 10 by a screw (not shown). An integral pressure switch (not shown) is provided in the back cover 12 with the diaphragm plate 14 being provided with a fifth defined circular region 66, smaller than the other regions 16, the rear of the diaphragm support plate 50 having a similarly shaped aperture 68 with wall surround to accommodate the circular region 66. A micro-switch is retained in an enclosure 82 on the back cover 12 by an upstand 80 in the diaphragm support plate 50 is activated by movement of the fifth circular region 66 serving as a pressure switch pad, the electrical wires to the micro-switch being fed internally from the front face of the motor. The valve housing 26, on the same side as the inlet valve seats 34 are positioned, is provided with a track 70 between two inlet valve seats 34 leading from the hole 72 exiting on that side and centrally provided between the outlet valve seats 28 provided on the opposite side, the track 70 mating with a corresponding track 74 provided on the diaphragm plate 14. The mated tracks 70, 74 form a passage between the hole 72 and the fifth circular region 66 whereby any fluid leaving the outlet chamber 24 when under pressure through the screw travels along the passage and fills a void at the pressure pad on the opposite side of the diaphragm plate 14 from the pressure switch causing activation of the micro-switch to stop the pump.

Figure 15A:
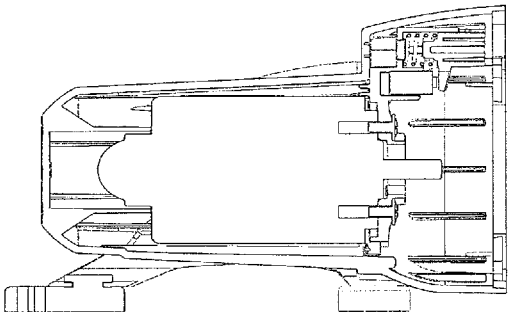
FIGS. 15A and 15B are side sectional views corresponding to FIGS. 7A and 7B but with the motor, motor locking plate; micro-switch within the micro-switch enclosure and the spiral spring and plunger within the plunger barrel, all shown located within the motor housing.
Figure 15B:
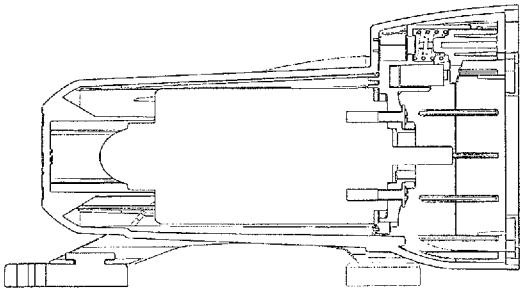
Figure 16A:
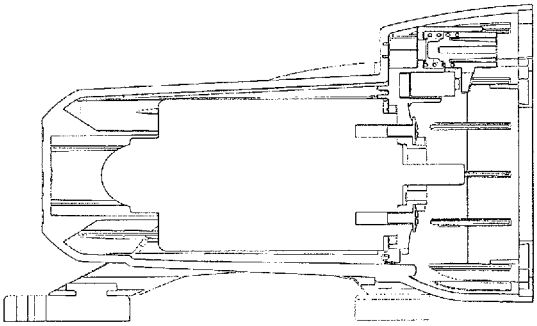
FIGS. 16A and 16B are side sectional views of an alternative embodiment of that shown in FIGS. 15A and 15*b*, respectively, with a longer plunger being included in the embodiment of FIGS. 16A and 16B.
Figure 16B:
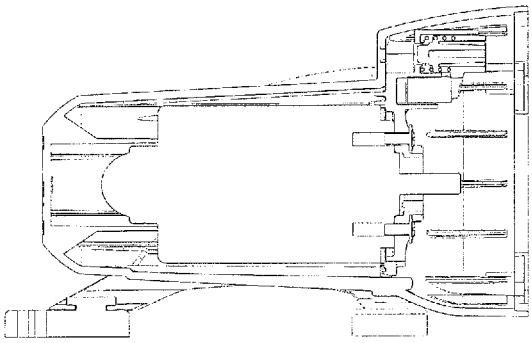
Figure 17A:
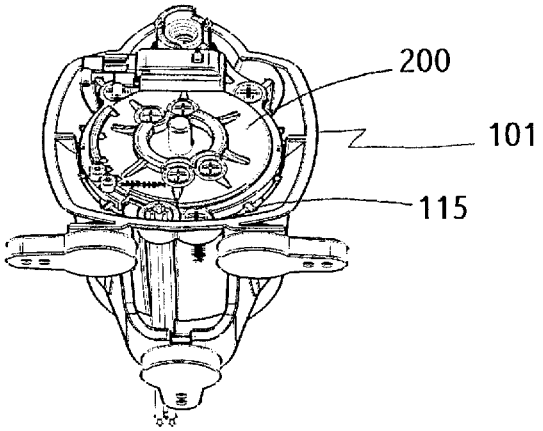
FIGS. 17A, 17B and 17C show the ribs provided at spaced apart intervals along the inside of the motor housing.
Figure 17B:
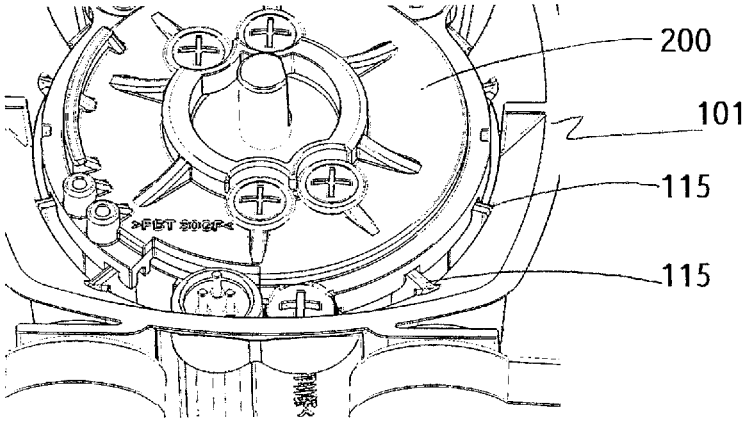
Figure 17C:
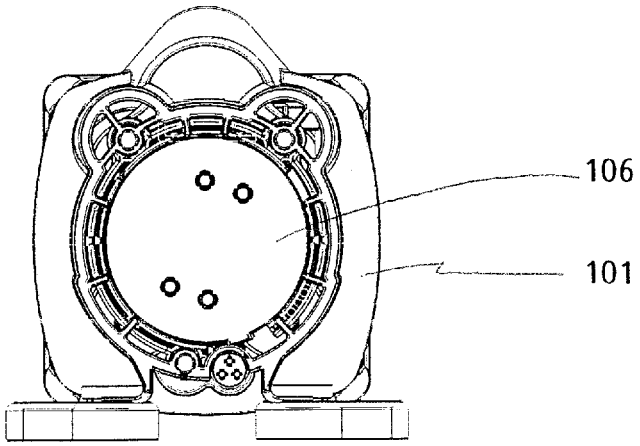
Figure 17D:
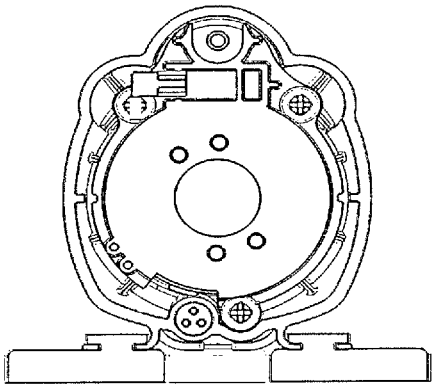
FIG. 17D is a sectional view taken of the motor housing and motor as shown in FIG. 17C.
Figure 17E:
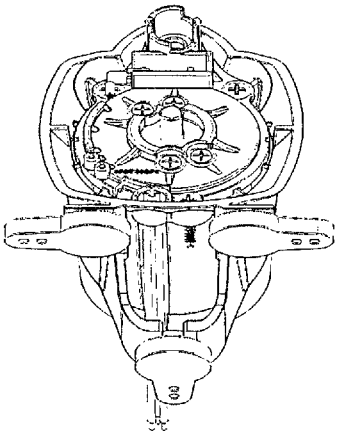
FIGS. 17E and 17F are further views corresponding to FIGS. 17A and 17B.
Figure 17F:
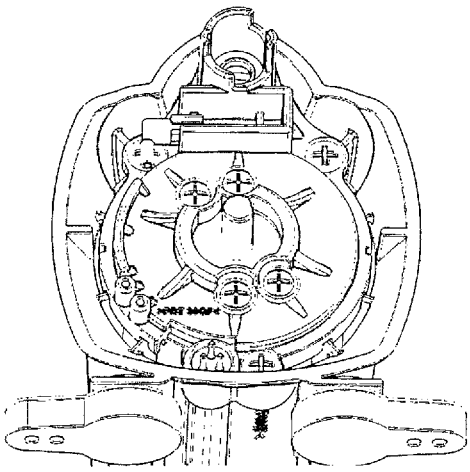
Figure 18:
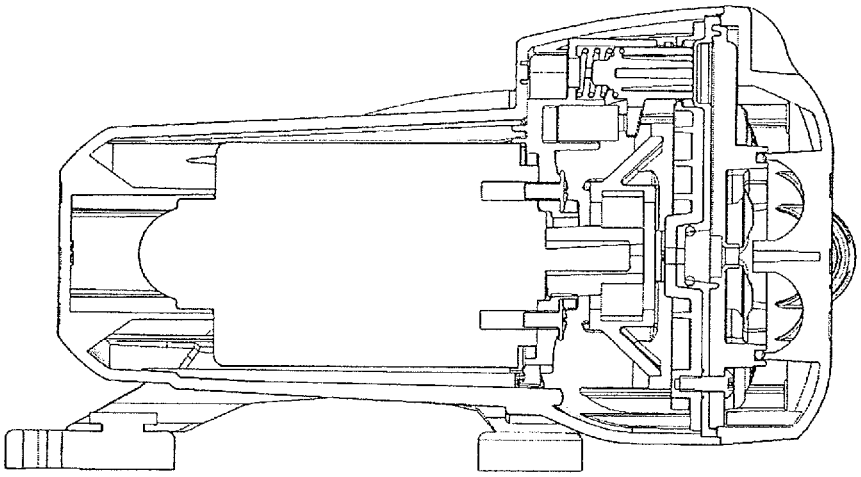
FIG. 18 is a sectional view of the assembled diaphragm pump shown in FIG. 14.
Figure 19:
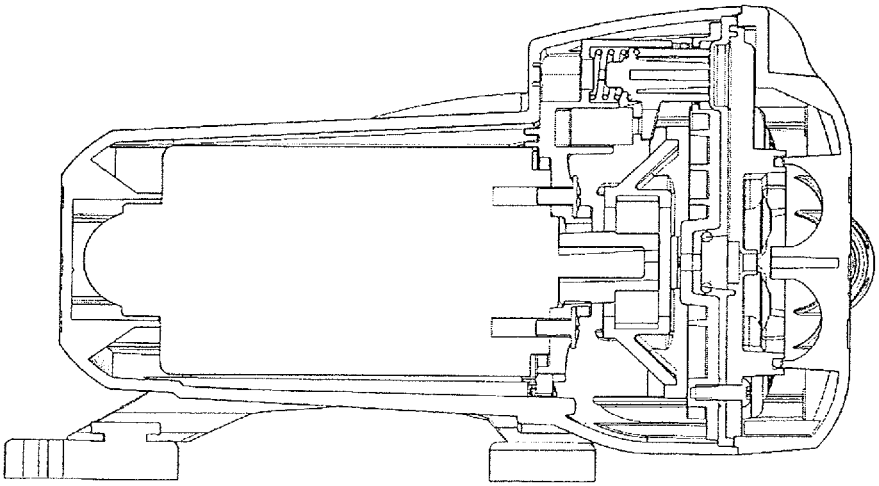
FIG. 19 is a sectional view of the assembled diaphragm pump an alternative embodiment with a longer motor being included in the motor housing than the motor shown in FIG. 18.
Figure 20A:
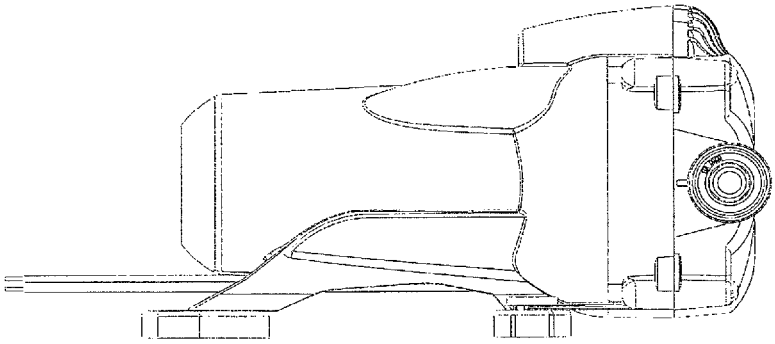
FIGS. 20A, 20B and 20C respectively show the assembled diaphragm pump in accordance with the present invention mounted in a horizontal position.
Figure 20B:
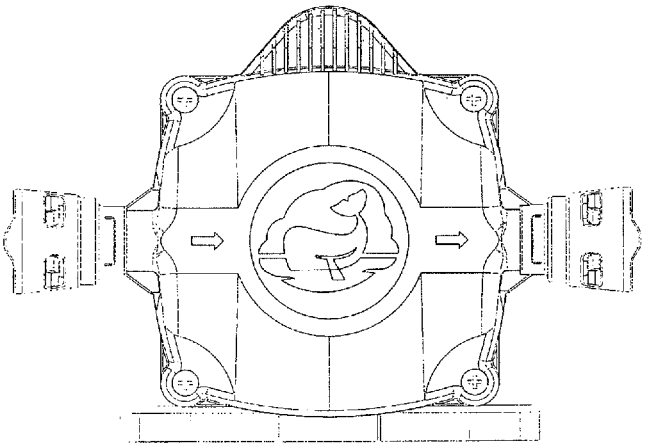
Figure 20C:
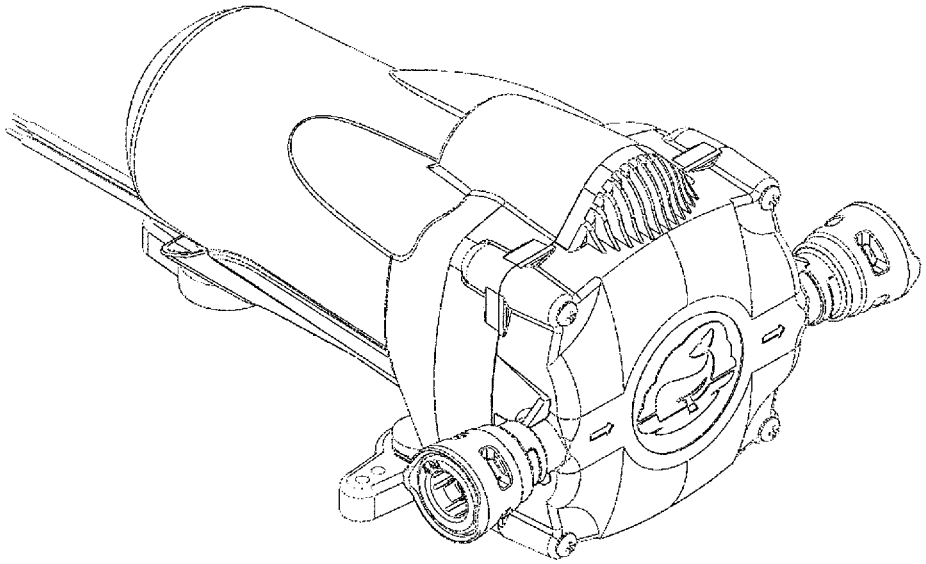

Referring now particularly to FIGS. 15A and 15B, these Figures show a first embodiment of a plunger; and referring to FIGS. 16A and 16B which show a second embodiment of a plunger, the function of the plunger 303, 303' will be described.

The length of the plunger 303 determines the pressure of the pump. Therefore, the available pressure of the pump is pre-determined at the design and manufacturing stage rather than by the end user. The motor therefore is operated within its optimum range of power and is more likely to have a longer life span.

The length of the plunger 303, 303' determines the pressure setting of the diaphragm pump 100. A shorter length plunger 303 as shown in FIGS. 15A and 15B determines that the pressure of the pump will be at a lower setting i.e. 2 bar pressure. A longer length plunger as shown in FIGS. 16A and 16B determines that the pressure will be at a higher setting, i.e. 3 bar.

At one end of the plunger 303 is the circular region 16 of the diaphragm plate 14 while at the other end of the plunger is the spiral spring against which the plunger 303 presses as it is pressed downwardly in the barrel 203 on the motor locking plate 200.

The longer plunger 303' exerts more of a force on the circular region 16 of the diaphragm plate 14 and therefore the pressure exerted by the pump 10 will be higher (i.e. at 3 bar rather than 2 bar).

The advantage of pre-determining the pressure setting of the pump using the plunger is that there is less likelihood of over stressing the pump in use and therefore longer pump life is achieved.

In use, with the inlet and outlet ports connected to a supply source and a demand requirement and the motor connected to a supply of electricity, the diaphragm pump 100 can be switched on to pump, in an even flow, fluid, normally water, from the supply source. The motor M drives the wobble plate 40 to nutate and reciprocate the piston sections and circular regions of the diaphragm plate in a pumping action so as to operate the diaphragm pump 100.

One of the advantages of the improved diaphragm pump 100 is that there is only one seal involved between the motor housing 110 and the cover 10 whereas previously there were two seals which had to be achieved in the prior art two-part casings.

It will of course be understood that aspects of the present invention have been described by way of example only and it should be appreciated that additions and/or modifications may be made thereto without departing from the spirit and scope of the present invention.

The invention claimed is:

1. A diaphragm pump comprising:

a motor;

an integrally formed housing for receiving and securely holding the motor, the housing comprising:

an elongate portion having a closed end, an open end and inside walls extending therebetween, the elongate portion being adapted to securely receive and house the motor; and a collar portion being provided at the open end of the elongate portion;

a cover for the housing having axially aligned inlet and outlet ports, each leading to mutually exclusive inlet and outlet chambers respectively, the cover being adapted to engage with the housing;

a motor locking plate secured to the motor by screws, such that when the motor locking plate is secured to the motor and with the motor inserted in the elongate portion of the housing, at least a portion of the motor locking plate is provided within the collar portion, wherein the motor locking plate comprises a barrel for receiving a spiral spring and a plunger;

a diaphragm plate extending across the open end of the housing between the collar portion of the housing and the cover and being secured therebetween when the cover is engaged with the collar portion of the housing, the diaphragm plate having a plurality of similarly defined circular regions;

a valve housing securable inside the cover and having defined therein at least one outlet valve seat and at least one inlet valve seat, the at least one outlet valve seat being in fluid communication with the outlet chamber and the at least one inlet valve seat being in fluid communication with the inlet chamber; and a wobble plate positioned within the collar portion of the housing, the wobble plate having a central boss and a plurality of similar piston sections equal in number to the number of circular regions on the diaphragm plate, the piston sections and circular regions on the diaphragm plate being correspondingly secured together, whereby in use, when the motor is activated, the wobble plate is subject to nutating motion to cause reciprocating action of the circular regions and thereby provide a pumping action.

2. A pump as claimed in claim 1 wherein the elongate portion of the housing is provided with a plurality of elongate ribs provided at spaced apart locations on the inside walls of the elongate portion.

3. A pump as claimed in claim 1 wherein the motor has a plurality of mounting feet fitted thereto, the feet being formed of resilient material.

4. A pump as claimed in claim 1 wherein the outlet valve seat has fluid passages therethrough and the at least one valve seat has a corresponding concave resilient valve seated therein.

5. A pump as claimed in claim 1 wherein the pump has a plurality of inlet valve seats, equal in number to the number of circular regions on the diaphragm plate, each inlet valve seat having a corresponding concave resilient valve seated therein, and each inlet valve seat having fluid passages therethrough.

6. A pump as claimed in claim 1 wherein the valve housing is provided, on the same side as the inlet valve seats are positioned, with a track leading from a hole exiting on that side and centrally provided in the outlet valve seat provided on the opposite side, the track mating with a corresponding track provided in the diaphragm plate, the mated tracks forming a passage between the hole and the further circular region whereby any fluid leaving the outlet chamber when under pressure, travels along the passage and fills a void at a pressure pad on the opposite side of the diaphragm plate from the pressure switch thereby causing activation of a micro-switch to stop the pump.

7. A pump as claimed in claim 1 wherein the motor locking plate is adapted to receive a drive shaft of the motor therethrough.

8. A pump as claimed in claim 1 wherein the plunger includes an arm operable for pressing on a micro-switch when the plunger is pressed inwardly so as to activate the micro-switch and thereby activating the motor.

9. A pump as claimed in claim 1 wherein the plunger can be of different lengths so as to pre-set the maximum pressure of the pump to a pre-determined setting.

10. A pump as claimed in claim 1 wherein the motor locking plate is secured to the housing by housing mounting screws.

11. A pump as claimed in claim 1 wherein the motor housing is adapted to receive and house a motor of a relatively short dimension or a relatively longer dimension.

12. A pump as claimed in claim 1 wherein a diaphragm support plate for supporting the diaphragm plate is provided in the collar portion of the housing, the diaphragm support plate having an equal number of similar apertures corresponding to the number of circular regions on the diaphragm plate, each aperture having a walled surround, the circular regions of the diaphragm plate fitting into respective apertures in the diaphragm support plate and being supported thereby.

13. A pump as claimed in claim 12 wherein on one side, the diaphragm plate is provided with a further defined circular region, which is smaller than the other plurality of defined circular regions, and wherein on one side, the diaphragm support plate has a similarly shaped aperture with wall surround to accommodate a micro-switch activated by movement of the further circular region serving as a pressure switch pad.

14. A pump as claimed in claim 1 wherein the motor locking plate comprises an enclosure for receiving and housing an integral pressure switch on the motor locking plate.

15. A pump as claimed in claim 14 wherein electrical wires to the switch are fed internally from a front face of the motor.

16. A pump as claimed in claim 1 wherein the motor locking plate comprises an engagement lug for engaging with the wobble plate.

17. A pump as claimed in claim 16, wherein a plurality of radially extending ribs extend from around the engagement lug.

18. A pump as claimed in claim 16 wherein the engagement lug is adapted for engagement with the wobble plate such that a drive shaft of the motor is engaged with a bearing on the wobble plate to drive the nutating action of the wobble plate so as to cause movement of the circular portions of the diaphragm plate.

* * * * *